US010131454B2

(12) United States Patent
Kim

(10) Patent No.: US 10,131,454 B2
(45) Date of Patent: Nov. 20, 2018

(54) APPARATUS FOR PACKING AMMUNITION CARTON IN POUCH

(71) Applicant: POONGSAN CORPORATION, Pyeongtaek-si, Gyeonggi-do (KR)

(72) Inventor: Dong Hyun Kim, Busan (KR)

( * ) Notice: Subject to any disclaimer, the term of this patent is extended or adjusted under 35 U.S.C. 154(b) by 158 days.

(21) Appl. No.: 15/337,152

(22) Filed: Oct. 28, 2016

(65) Prior Publication Data

US 2017/0183111 A1 Jun. 29, 2017

(30) Foreign Application Priority Data

Dec. 28, 2015 (KR) ..... 10-2015-0187038

(51) Int. Cl.
*B65B 5/08* (2006.01)
*B65B 35/30* (2006.01)
(Continued)

(52) U.S. Cl.
CPC ..... *B65B 5/08* (2013.01); *B65B 5/045* (2013.01); *B65B 35/30* (2013.01); *B65B 39/007* (2013.01);
(Continued)

(58) Field of Classification Search
CPC ..... F42B 39/02; F42B 39/08; F42B 39/087; F42B 39/26; B65B 35/10; B65B 35/20;
(Continued)

(56) References Cited

U.S. PATENT DOCUMENTS 869,310 A * 10/1907 Lemly ..... F42B 39/02 224/239
1,170,259 A * 2/1916 Hooper ..... F42B 39/02 224/681
2009/0241487 A1* 10/2009 Actis ..... A01F 25/14 53/563
2010/0025447 A1* 2/2010 Smart ..... F42B 39/02 224/682
(Continued)

FOREIGN PATENT DOCUMENTS

JP 10-077005 3/1998
JP 2004-284603 10/2004
(Continued)

OTHER PUBLICATIONS

English translation of 10-1568993.
(Continued)

*Primary Examiner* — Hemant M Desai
*Assistant Examiner* — Eduardo R Ferrero
(74) *Attorney, Agent, or Firm* — Antonio Ha & U.S. Patent, LLC

(57) ABSTRACT

An ammunition packing apparatus comprises an ammunition feeder receiving ammunition cartons and horizontally arranging the ammunition cartons in a left or right direction, an ammunition vertical conveyor vertically conveying the ammunition cartons to an ammunition horizontal conveyor, the ammunition horizontal conveyor advancing the ammunition cartons to an ammunition inserter, an ammunition pouch mounter placing and fastening empty ammunition pouches in a flat and stretched position, an ammunition pouch opener opening mouths of the ammunition pouches, and the ammunition inserter advancing and inserting the
(Continued)

ammunition cartons into the ammunition pouches, wherein the ammunition inserter includes spade-shaped inserting blades surrounding left and right surfaces and bottom surfaces of the ammunition cartons to allow the ammunition cartons to be inserted without being stuck to rims of the ammunition pouches and ammunition return preventers preventing the ammunition cartons from moving back when the ammunition inserting blades return after advancing and inserting the ammunition cartons.

7 Claims, 12 Drawing Sheets

(51) Int. Cl.

| | |
|---|---|
| ***B65B 39/00*** | (2006.01) |
| ***B65B 39/12*** | (2006.01) |
| ***B65B 43/36*** | (2006.01) |
| ***F42B 39/26*** | (2006.01) |
| ***B65B 5/04*** | (2006.01) |
| ***F42B 39/02*** | (2006.01) |
| *B65B 43/39* | (2006.01) |
| *F41A 9/87* | (2006.01) |

(52) U.S. Cl.
CPC ..... *B65B 39/12* (2013.01); *B65B 43/36* (2013.01); *F42B 39/02* (2013.01); *F42B 39/26* (2013.01); *B65B 43/39* (2013.01); *B65B 2039/009* (2013.01); *F41A 9/87* (2013.01)

(58) Field of Classification Search
CPC ..... B65B 5/045; B65B 43/36; B65B 43/26; B65B 43/28; B65B 43/34; B65B 43/39; B65B 39/007; B65B 39/12
USPC ..... 53/255, 257, 384.1, 385.1, 570
See application file for complete search history.

(56) References Cited

U.S. PATENT DOCUMENTS 1,175,584 A * 3/1916 Batchelder ..... F42B 39/02 224/196
1,282,695 A * 10/1918 Jennings ..... F42B 39/02 224/240
2,601,480 A * 6/1952 Williams ..... B65B 43/36 493/255
2,620,961 A * 12/1952 Wahl ..... B65B 43/39 15/309.2
2,918,773 A * 12/1959 Krupp ..... B65B 21/00 414/411
3,197,936 A * 8/1965 Messmer ..... B65B 43/36 53/385.1
3,201,915 A * 8/1965 Yanulaitis ..... B65B 51/20 493/183
3,206,913 A * 9/1965 Fleigher ..... B65B 43/36 53/385.1
3,254,468 A * 6/1966 Lerner ..... B65B 43/36 383/35
3,330,093 A * 7/1967 Schorer ..... B65B 43/36 53/385.1
3,451,195 A * 6/1969 Fissel ..... B65B 43/39 493/446
3,455,088 A * 7/1969 Lerner ..... B65B 43/36 53/385.1
3,538,671 A * 11/1970 Wallace ..... B65B 43/36 53/385.1
3,552,090 A * 1/1971 Roberts et al. ..... B65B 43/123 156/443
3,578,152 A * 5/1971 Hartley ..... B65D 5/10 206/3
3,579,951 A * 5/1971 Lowery ..... B65B 43/36 53/385.1
3,579,957 A * 5/1971 Mills, Jr. ..... B65B 5/045 53/261
3,603,059 A * 9/1971 Carnes ..... B65B 5/045 53/258
3,605,383 A * 9/1971 Piazze ..... B65B 43/36 53/385.1
3,616,976 A * 11/1971 Geretschlaeger ..... F42B 39/02 206/3
3,727,374 A * 4/1973 Williams ..... B65B 43/36 53/261
3,756,387 A * 9/1973 Chaney ..... F42B 39/02 206/3
3,763,627 A * 10/1973 Kupcikevicius ..... B65B 25/065 53/385.1
3,793,797 A * 2/1974 Roberts ..... B65B 43/36 53/459
3,889,449 A * 6/1975 Membrino ..... B65B 43/36 53/284.7
3,908,343 A * 9/1975 Farrelly ..... B65B 43/123 53/385.1
3,925,967 A * 12/1975 Bloemhof ..... B65B 25/16 53/261
3,935,691 A * 2/1976 Broch ..... B65B 25/16 53/385.1
3,971,191 A * 7/1976 Hoyland ..... B65B 25/064 53/258
4,047,362 A * 9/1977 Lister ..... B65B 5/067 53/258
4,147,012 A * 4/1979 van Mil ..... B65B 25/064 53/258
4,183,194 A * 1/1980 Lucke ..... B65B 5/067 53/371.6
4,226,041 A * 10/1980 Goodworth ..... F41A 9/67 206/3
4,241,562 A * 12/1980 Meyer ..... B65B 5/067 53/258
4,352,263 A * 10/1982 Andrews, Jr. ..... B65B 5/045 53/258
4,457,124 A * 7/1984 Hartmann ..... B65B 5/045 53/284.7
5,185,984 A * 2/1993 Tisma ..... B65B 35/205 53/252
5,361,562 A * 11/1994 Nagaoka ..... B65B 43/40 414/411
5,483,786 A * 1/1996 Giesbrecht ..... B65B 5/045 53/257
5,743,071 A * 4/1998 Wolthuizen ..... B65B 5/045 53/252
5,782,066 A * 7/1998 Giesbrecht ..... B65B 43/26 53/386.1
5,799,465 A * 9/1998 Townsend ..... B65B 5/067 53/257
6,328,152 B1 * 12/2001 Focke ..... B65B 19/225 198/468.1
6,332,530 B1 * 12/2001 Grossmann ..... B65B 19/223 198/468.8
6,421,984 B1 * 7/2002 Murgatroyd ..... B65B 25/16 53/284.7
6,516,587 B1 * 2/2003 Chikatani ..... B65B 43/26 53/384.1
6,792,737 B2 * 9/2004 Dharssi ..... B65B 5/045 53/238
6,793,613 B2 * 9/2004 DeSmedt ..... B65B 5/045 493/194
7,284,359 B2 * 10/2007 Haschke ..... A22C 11/005 53/252
2002/0094924 A1 * 7/2002 Pinto ..... B65B 5/045 493/309
2002/0134702 A1 * 9/2002 DeSmedt ..... B65B 5/045 206/554
2005/0022467 A1 * 2/2005 Kujubu ..... B65B 5/045 53/67
2007/0017187 A1 * 1/2007 Chikatani ..... B65B 43/36 53/459

(56) References Cited

U.S. PATENT DOCUMENTS

| | | | | |
|---|---|---|---|---|
| 2010/0255164 | A1* | 10/2010 | Stackley | B65B 5/045 426/410 |
| 2011/0030319 | A1* | 2/2011 | O'Malley | B65B 5/04 53/473 |
| 2011/0262603 | A1* | 10/2011 | Blattner | B65B 25/001 426/323 |
| 2013/0247512 | A1* | 9/2013 | Haschke | B65B 37/00 53/235 |
| 2013/0291485 | A1* | 11/2013 | McCorkle | B65B 5/045 53/384.1 |
| 2015/0274338 | A1* | 10/2015 | Kawano | B65B 35/205 53/556 |

FOREIGN PATENT DOCUMENTS

| | | |
|---|---|---|
| KR | 1999-030156 | 4/1999 |
| KR | 20-0296666 | 12/2002 |
| KR | 2003-0004295 | 1/2003 |
| KR | 10-1272049 | 6/2013 |
| KR | 10-1283788 | 7/2013 |
| KR | 20-2015-0000475 | 1/2015 |
| KR | 10-1568993 | 11/2015 |

OTHER PUBLICATIONS

English translation of 20-0296666.
English translation of 20-2015-0000475.
English translation of 10-1272049.
English translation of 1999-030156.
English translation of 10-1283788.
English translation of 2004-284603.
English translation of 10-077005.
English translation of 2003-0004295.

* cited by examiner

APPARATUS FOR PACKING AMMUNITION CARTON IN POUCH

CROSS-REFERENCE TO RELATED APPLICATIONS

This patent application claims priority under 35 U.S.C. § 119 to Korean Patent Application No. 10-2015-0187038, filed on Dec. 28, 2015, in the Korean Intellectual Property Office, the disclosure of which is incorporated by reference herein in its entirety.

TECHNICAL FIELD

The present disclosure concerns ammunition packaging, and more specifically, to automated ways for packaging ammunition cartons filled with ammunition cartridges into flexible pouches.

DISCUSSION OF RELATED ART

Ammunition pouches are designed to carry a particular size or type of ammunition cartons. These ammunition pouches are primarily constructed of flexible fabrics that seldom remain at a particular shape during a packing process. The packing of ammunition cartons, which deals with highly dangerous products, should be done in a more delicate and accurate manner without damaging them. For such reasons, it is quite tricky and time consuming to pack ammunition cartons into their respective pouches, whether manually or automatically.

SUMMARY

According to an embodiment of the present disclosure, an apparatus for packing an ammunition carton in a pouch comprises an ammunition feeder receiving ammunition cartons and horizontally arranging the ammunition cartons in a left or right direction, an ammunition vertical conveyor vertically conveying the horizontally arranged ammunition cartons to an ammunition horizontal conveyor disposed thereon, the ammunition horizontal conveyor advancing the vertically conveyed ammunition cartons to an ammunition inserter disposed in front thereof, an ammunition pouch mounter disposed in front of the ammunition inserter and placing and fastening empty ammunition pouches in a flat and stretched position, an ammunition pouch opener opening mouths of the ammunition pouches placed and fastened by the ammunition pouch mounter, and the ammunition inserter advancing and inserting the ammunition cartons into the ammunition pouches, wherein the ammunition inserter includes spade-shaped inserting blades surrounding left and right surfaces and bottom surfaces of the ammunition cartons to allow the ammunition cartons to be inserted without being stuck to rims of the ammunition pouches and ammunition return preventers preventing the ammunition cartons from moving back when the ammunition inserting blades return after advancing and inserting the ammunition cartons.

The ammunition pouch opener includes ammunition pouch opening scoops including rear edges capable of penetrating covers of the ammunition pouches and front books capable of lifting the rims of the ammunition pouches and an opening scoop actuator moving forth and back the ammunition pouch opening scoops in an wrier or lower direction and a front or rear direction.

The rear edges of the ammunition pouch opening scoops include air outlets through which air is blown into insides of the covers of the ammunition pouches.

The ammunition pouch opening scoops whose number is the same as the number of the ammunition pouches are horizontally arranged, and a left-right interval between the ammunition pouch opening scoops is varied by a scoop interval adjustor, and wherein the opening scoop actuator moves back and forth in the upper or lower direction and the front or rear direction regardless of the variation in the left-right interval by the scoop interval adjustor.

The ammunition pouch opening scoops open the ammunition pouches by such an operation that the rear edges of the ammunition pouch opening scoops move back to the covers of the ammunition pouches while the air is blown into the insides of the covers of the ammunition pouches, and the rear edges of the ammunition pouch opening scoops then descend and advance so that the front hooks lift the rims of the ammunition pouches.

The ammunition pouch mounter includes ammunition pouch upper end clamps horizontally arranged to clamp and fasten upper ends of the ammunition pouches and ammunition pouch lower end clamps horizontally arranged to clamp and fasten lower ends of the ammunition pouches, the number of the ammunition pouch upper end clamps or the ammunition pouch lower end clamps being the same as the number of the ammunition pouches and a clamp interval adjustor varying a left-right interval between the ammunition pouch upper end clamps or between the ammunition pouch lower end clamps.

The scoop interval adjustor and the clamp interval adjustor are simultaneously operated when the ammunition pouches are opened so that a left-right interval between the ammunition pouches is the same as a left-right interval between the ammunition inserting blades.

BRIEF DESCRIPTION OF THE DRAWINGS

A more complete appreciation of the present disclosure and many of the attendant aspects thereof will be readily obtained as the same becomes better understood In reference to the following detailed description when considered in connection with the accompanying drawings, wherein.

DETAILED DESCRIPTION OF EXEMPLARY EMBODIMENTS

Hereinafter, exemplary embodiments of the present disclosure will be described in detail with reference to the accompanying drawings. The present disclosure, however, may be modified in various different ways, and should not be construed as limited to the embodiments set forth herein.

As used herein, the singular forms "a," "an," and "the" are intended to include the plural forms as well, unless the context clearly indicates otherwise. It will be understood that when an element or layer is referred to as being "on," "connected to," "coupled to," or "adjacent to" another element or layer, it can be directly on, connected, coupled, or adjacent to the other element or layer, or intervening elements or layers may be present. The same reference denotations may be used to refer to the same or substantially the same elements throughout the specification and the drawings.

Figure 1:
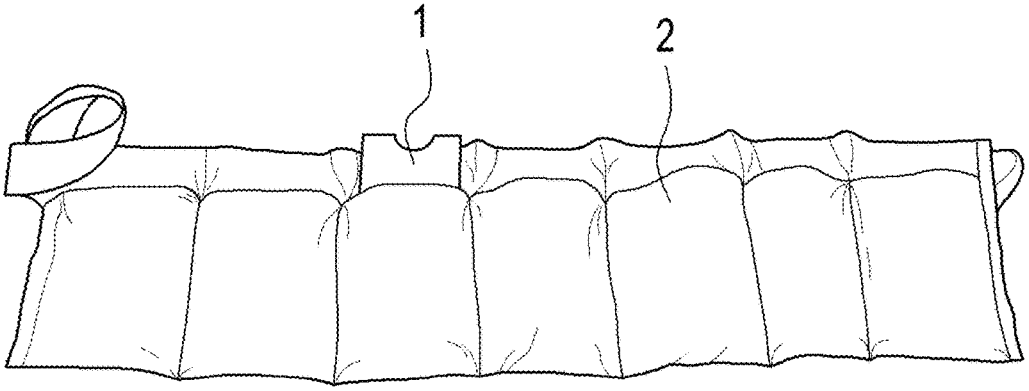
FIG. 1 illustrates ammunition cartons and ammunition pouches for packing the ammunition cartons according to an embodiment of the present disclosure.

FIG. 1 illustrates ammunition cartons and ammunition pouches for packing the ammunition cartons according to an embodiment of the present disclosure.

Referring to FIG. 1, two clips each bundling e.g., ten rounds of ammunition (also referred to as ammunition cartridges) may be packed in each of seven ammunition cartons, and the ammunition cartons mar be packed in multiple ammunition pouches, respectively. The ammunition pouches may be coupled together and tied with a strap for hanging over the user's shoulder or wearing on the user's waist. The ammunition pouches may be formed of fabric and may have flaps for naturally covering their open mouths to prevent the ammunition or ammunition cartons from escaping off while they are in use. The ammunition cartons may be formed of paper.

Figure 2:
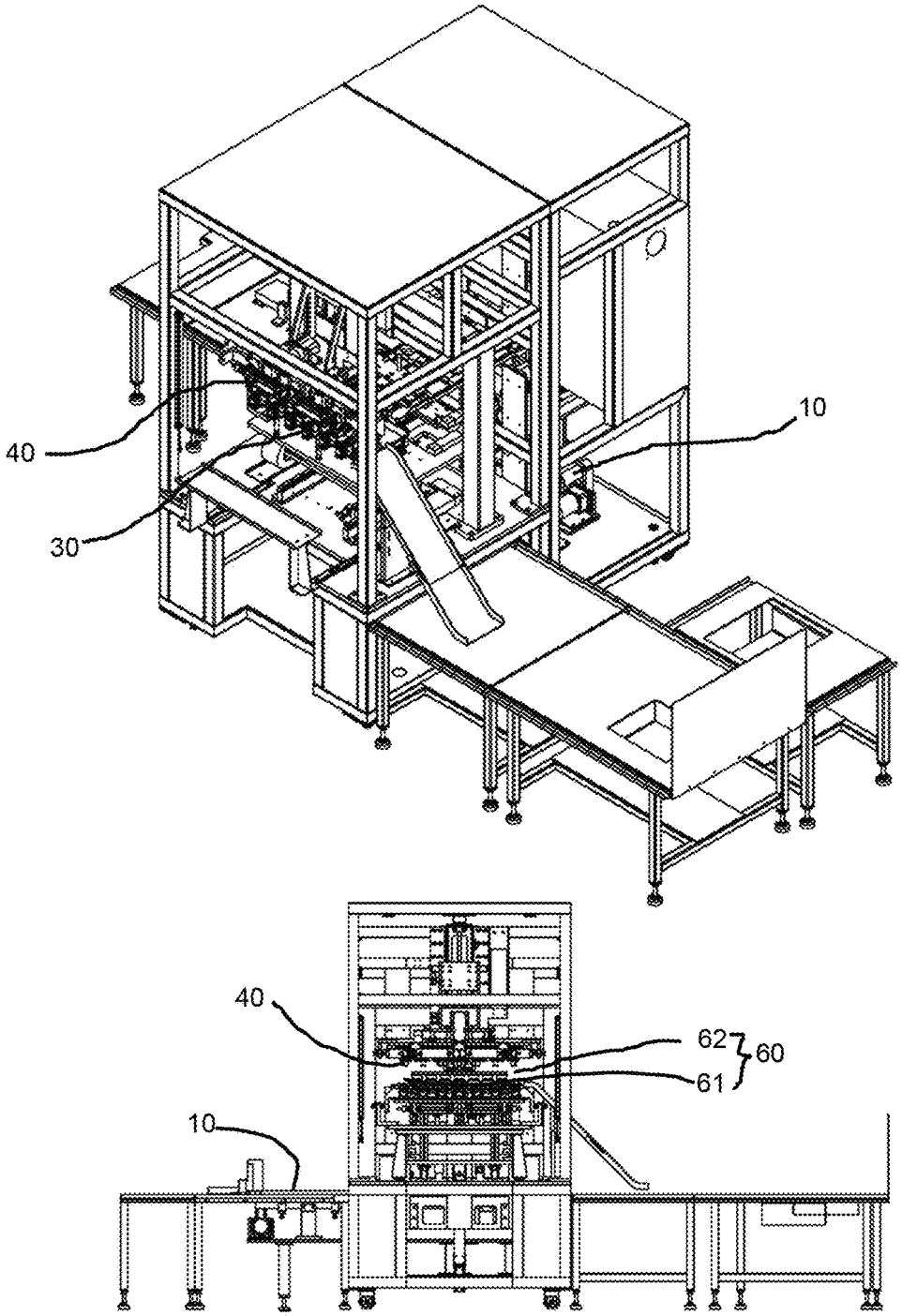
FIGS. 2 and 3 illustrate an ammunition carton packing apparatus according to at embodiment of the present disclosure.
Figure 3:
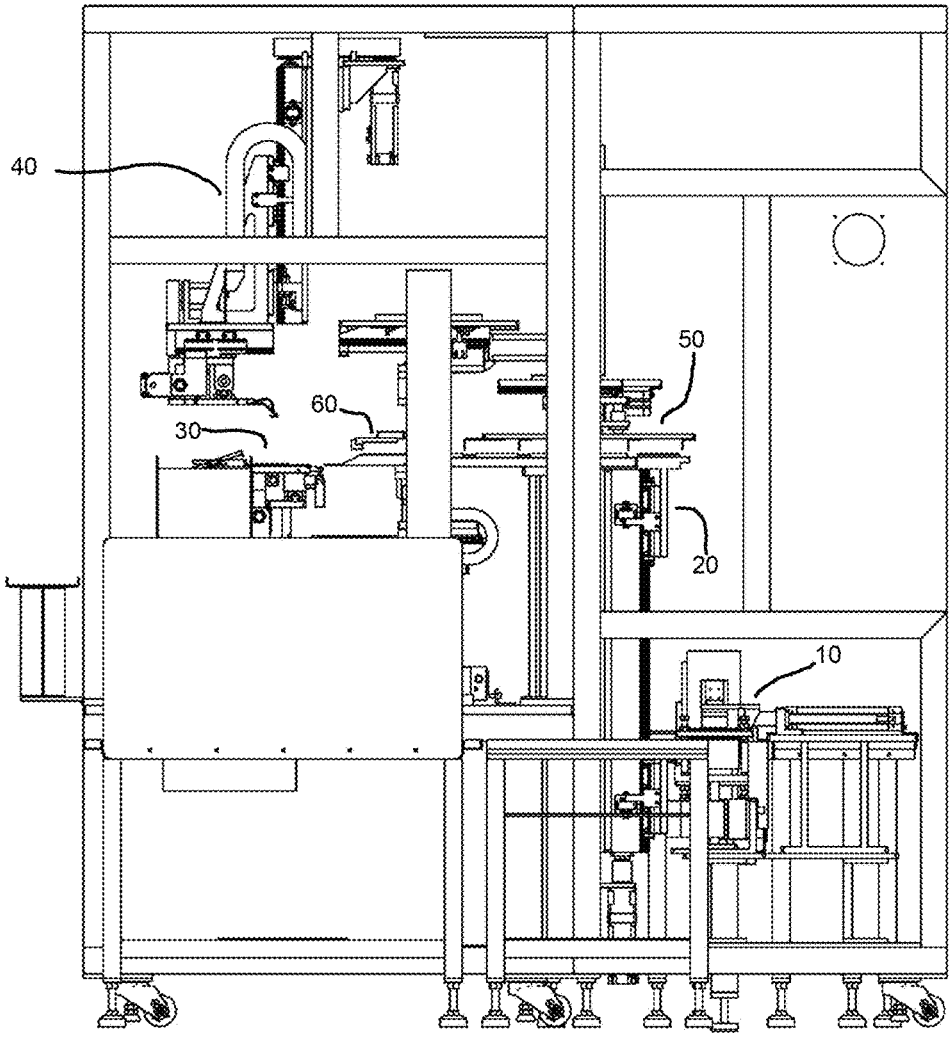
Figure 4:
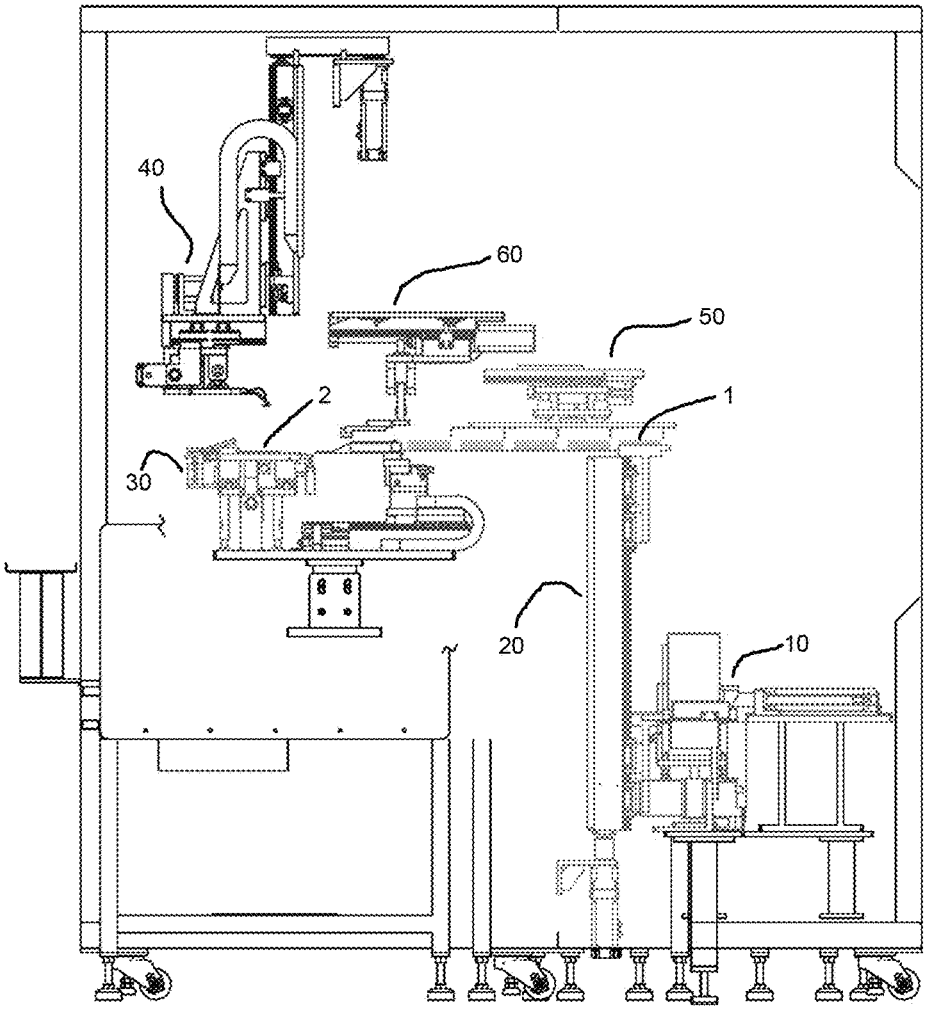
FIG. 4 is a view illustrating working modules in an ammunition carton packing apparatus according to an embodiment of the present disclosure.
Figure 5:
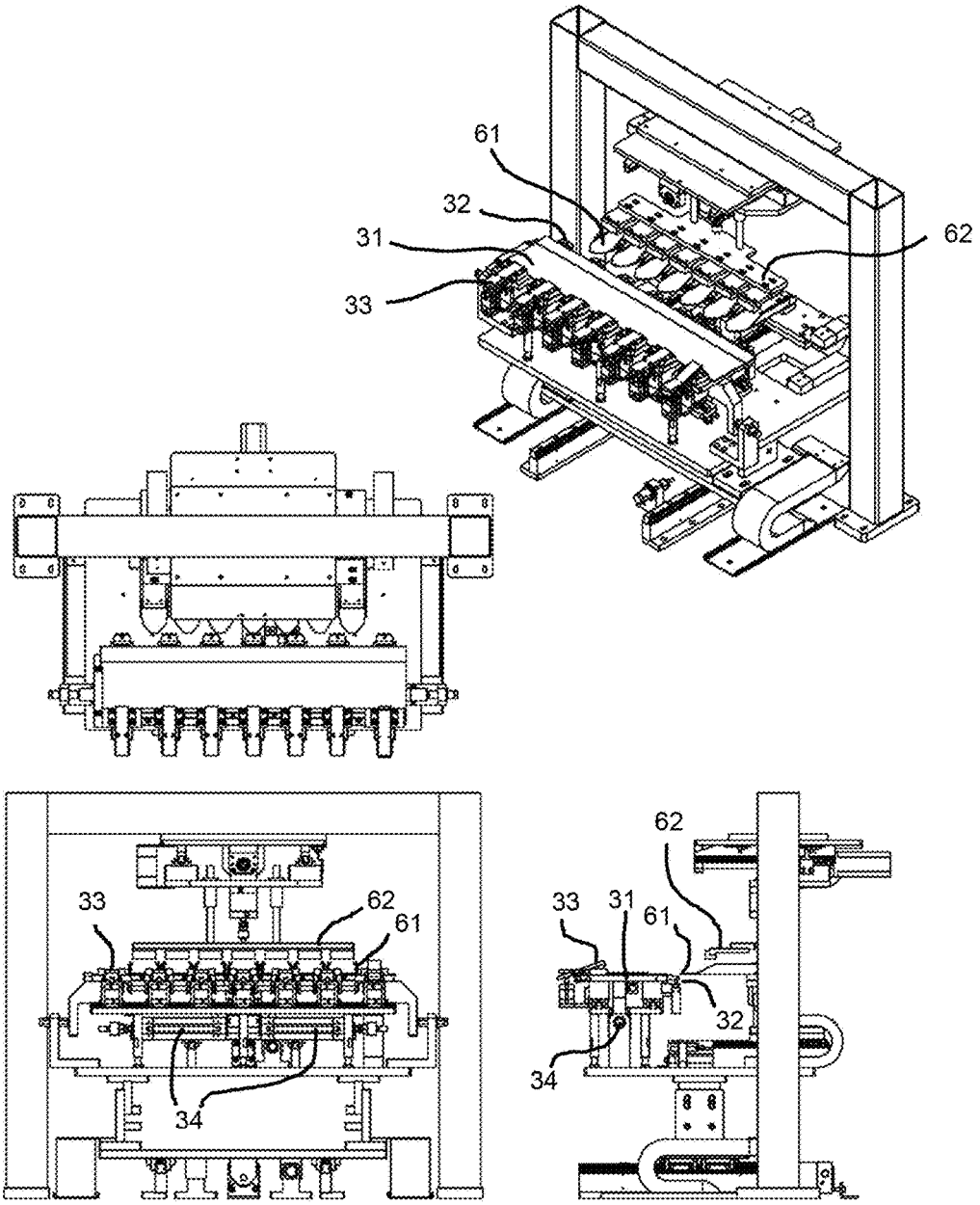
FIG. 5 illustrates an assembly of an ammunition pouch mounter and ammunition inserter of an ammunition carton packing apparatus according to an embodiment of the present disclosure.
Figure 6:
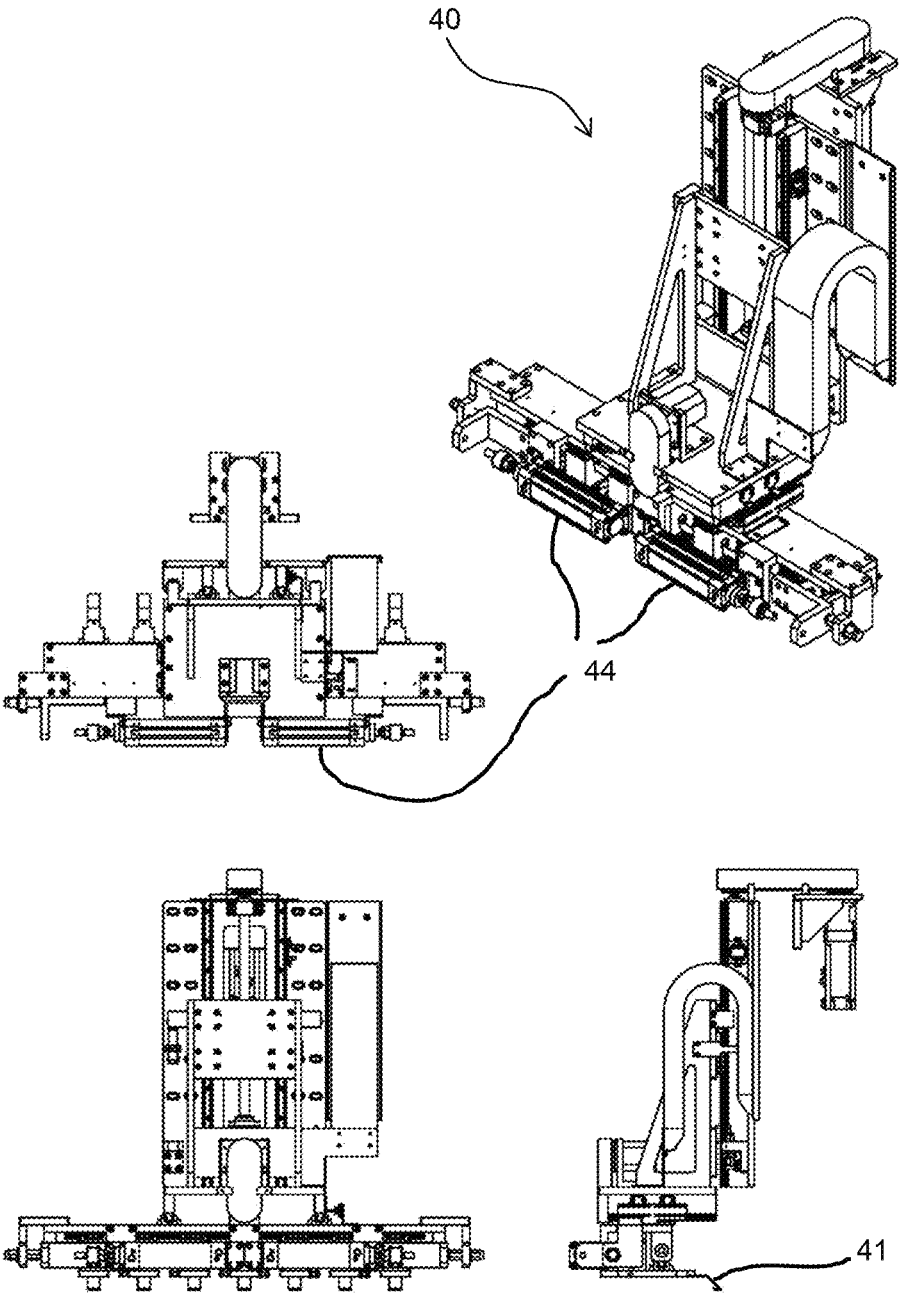
FIG. 6 illustrates an ammunition pouch opener of an ammunition carton packing apparatus according to an embodiment of the present disclosure.
Figure 7:
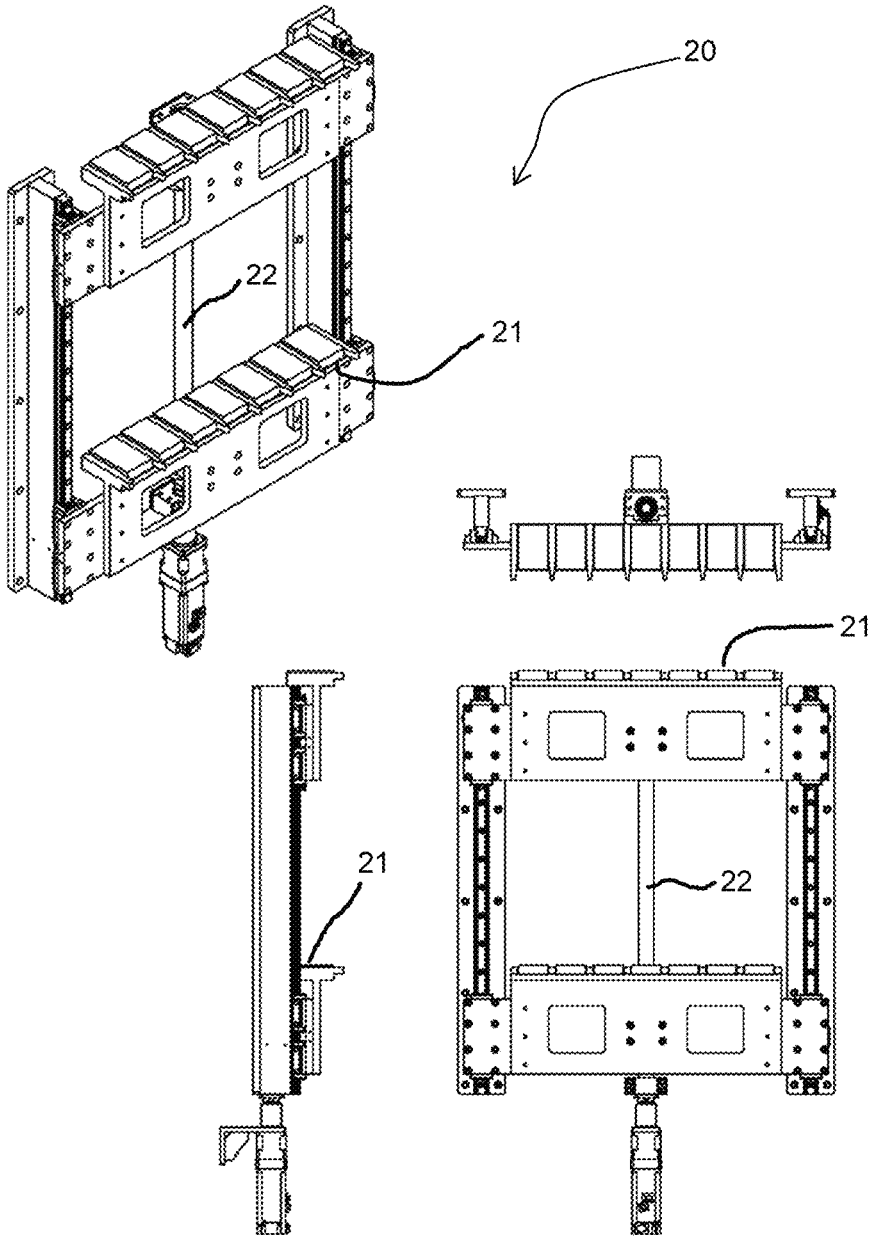
FIG. 7 illustrates an ammunition vertical conveyor of an ammunition carton packing apparatus according to an embodiment of the present disclosure.
Figure 8:
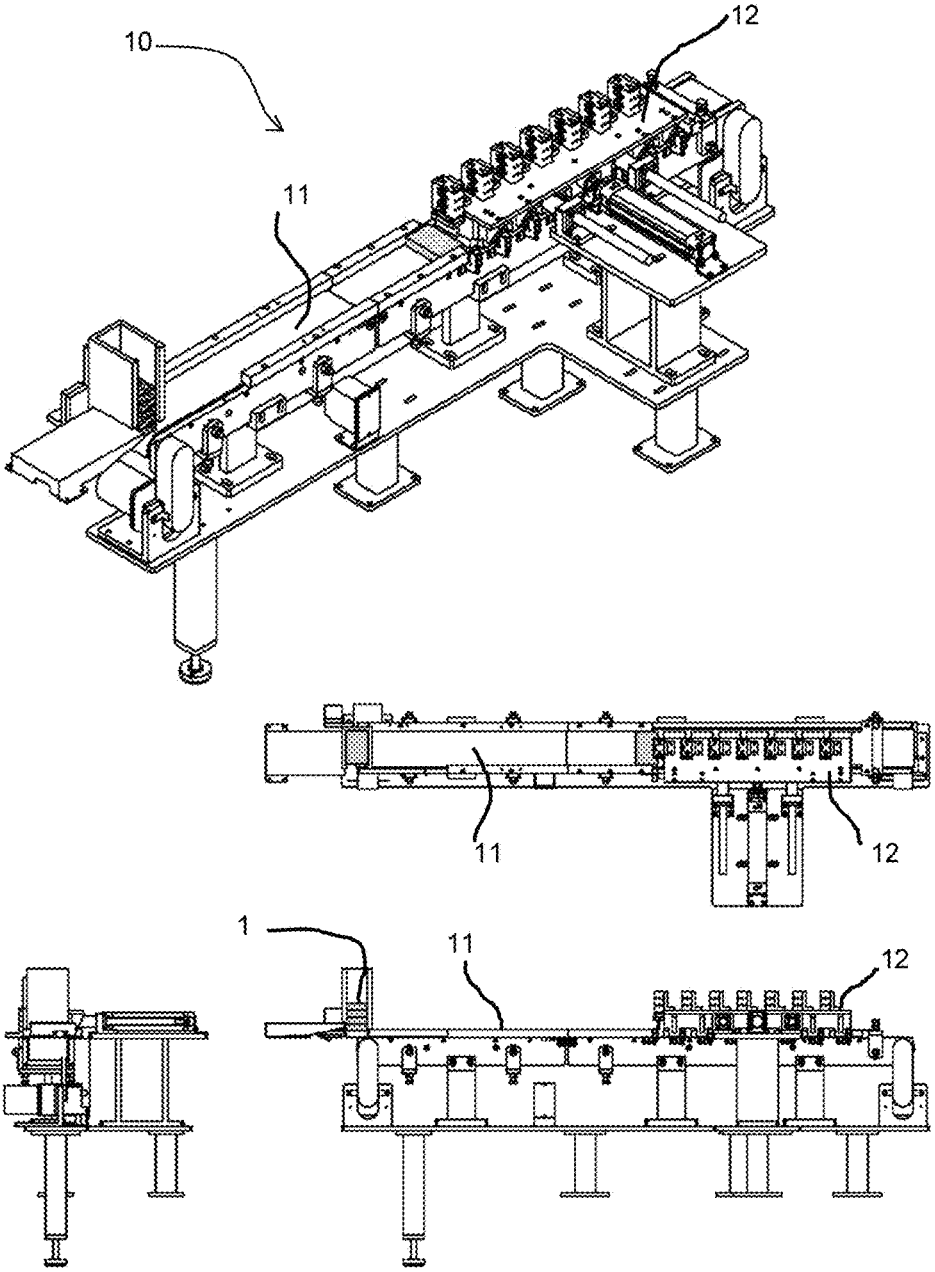
FIG. 8 illustrates an ammunition feeder of an ammunition carton packing apparatus according to an embodiment of the present disclosure.
Figure 9:
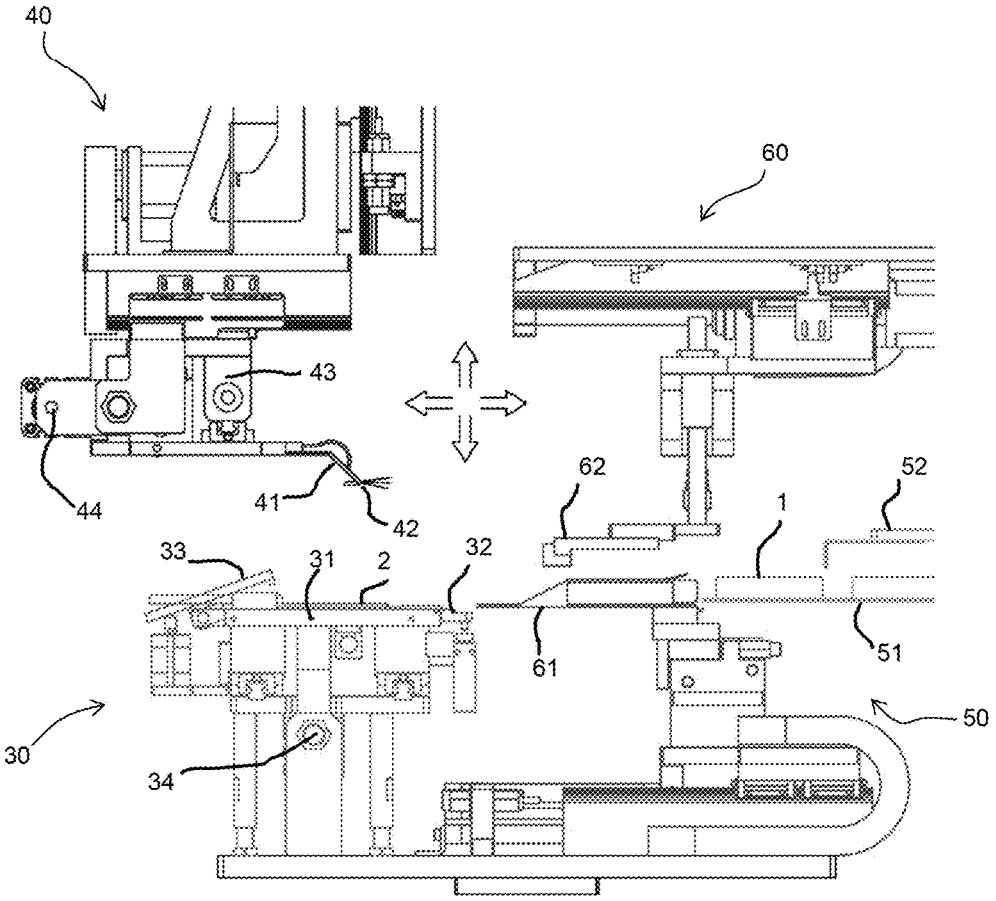
FIG. 9 illustrates an ammunition pouch mounter, ammunition pouch opener, ammunition horizontal conveyor, and ammunition inserter of an ammunition carton packing apparatus according to an embodiment of the present disclosure.
Figure 10:
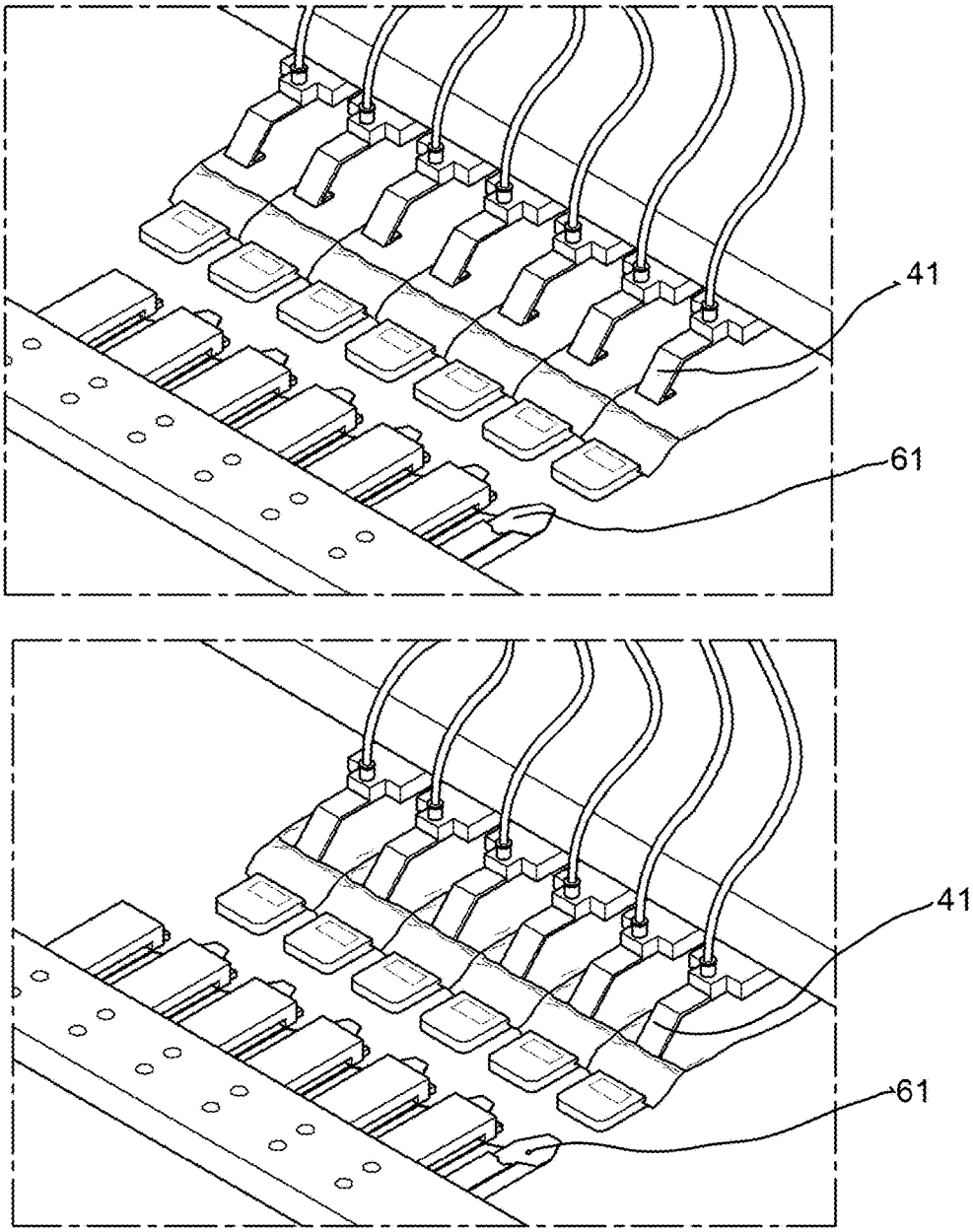
FIG. 10 illustrates a process for feeding ammunition and mounting ammunition pouches in sequence, according to an embodiment of the present disclosure.
Figure 11:
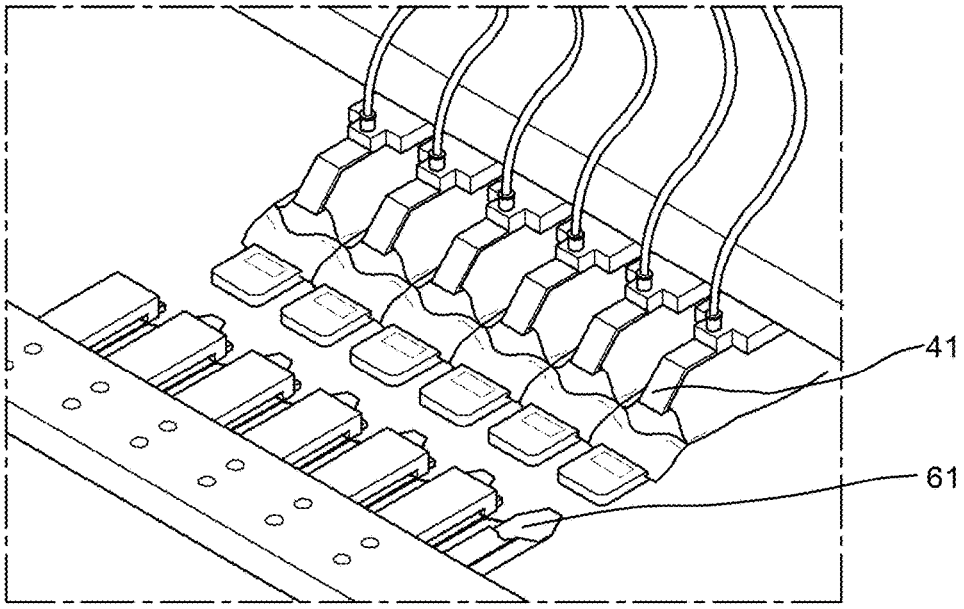
FIG. 11 illustrates a process performed by an ammunition pouch opener of an ammunition, carton packing apparatus according to an embodiment of the present disclosure.
Figure 12:
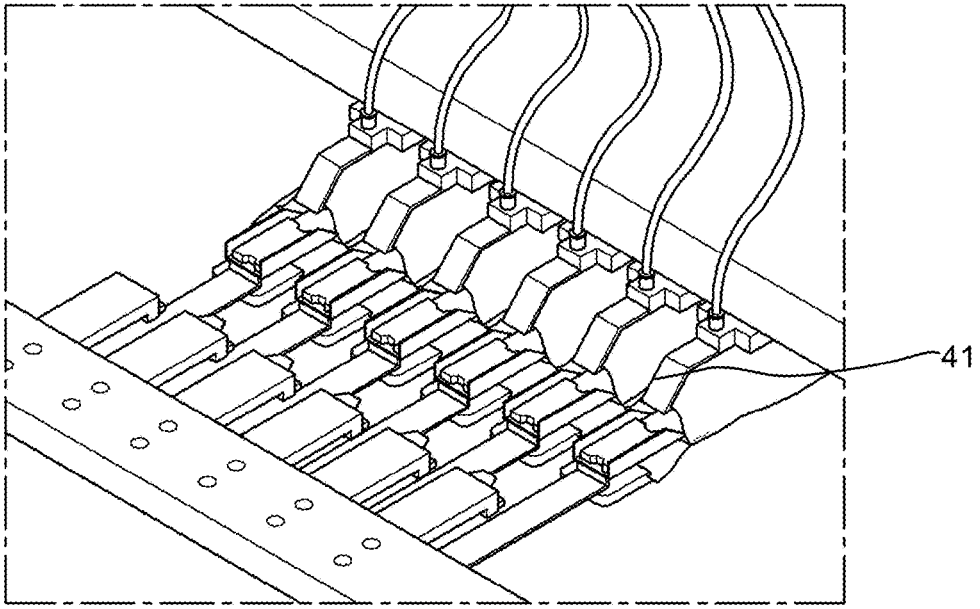
FIG. 12 illustrates a process performed by an ammunition inserter of an ammunition carton packing apparatus according to an embodiment of the present disclosure.

FIGS. 2 and 3 illustrate an ammunition carton packing apparatus according to an embodiment of the present disclosure. FIG. 4 is a view illustrating working modules in an ammunition carton packing apparatus according to an embodiment of the present disclosure. FIG. 5 illustrates an assembly of an ammunition pouch mounter and ammunition inserter of an ammunition carton packing apparatus according to an embodiment of the present disclosure. FIG. 6 illustrates an ammunition pouch opener of an ammunition carton packing apparatus according to an embodiment of the present disclosure. FIG. 7 illustrates au ammunition vertical conveyor of an ammunition carton packing apparatus according to an embodiment of the present disclosure. FIG. 8 illustrates an ammunition feeder of an ammunition carton packing apparatus according to an embodiment of the present disclosure. FIG. 9 illustrates an ammunition pouch mounter, ammunition pouch opener, ammunition horizontal conveyor, and ammunition inserter of an ammunition carton packing apparatus according to an embodiment of the present disclosure. FIG. 10 illustrates a process for feeding ammunition and mounting ammunition pouches in sequence, according to an embodiment of the present disclosure. FIG. 11 illustrates a process performed by an ammunition pouch opener of an ammunition carton packing apparatus according to an embodiment of the present disclosure. FIG. 12 illustrates a process performed by an ammunition inserter of an ammunition carton packing apparatus according to an embodiment of the present disclosure.

Referring to FIGS. 2 to 4, the ammunition carton packing apparatus may include a plurality of working modules. The working modules may include an ammunition feeder 10, an ammunition vertical conveyor 20, an ammunition pouch mounter 30, an ammunition pouch opener 40, an ammunition horizontal conveyor 50, and an ammunition inserter 60.

Ammunition cartridges may be packed in ammunition cartons 1. The ammunition feeder 10 may receive the ammunition cartons 1 and arrange the ammunition cartons 1 horizontally in a left-right direction. The ammunition horizontal conveyor 50 may be disposed on the ammunition vertical conveyor 20. The ammunition vertical conveyor 20 may vertically convey the horizontally arranged ammunition cartons 1 to the ammunition horizontal conveyor 50. The ammunition pouch mounter 30 may be disposed in front of the ammunition inserter 60. The ammunition pouch mounter 30 may place and fasten empty ammunition pouches 2 in a flat and stretched position. The ammunition pouch opener 40 may open the mouths of the ammunition pouches 2 placed and fastened by the ammunition pouch mounter 30. The ammunition horizontal conveyor 50 advances the vertically conveyed ammunition cartons 1 to the ammunition inserter 60. The ammunition inserter 60 may be disposed in front of the ammunition horizontal conveyor 50. For example, the ammunition inserter 60 may be disposed between the ammunition pouch mounter 30 and the ammunition horizontal conveyor 50. The ammunition inserter 60 may advance and insert the ammunition cartons 1 into the ammunition pouches 2.

The working modules may follow common references for operational directions. For example, the working modules array be operated in directions, e.g., front, rear, upper, and lower directions, as shown in FIG. 9.

As shown in FIG. 2, a shelter (not shown) may be disposed at a front side of the ammunition carton packing apparatus to place ammunition pouches 2 thereon, and a slide and stacking table may be disposed at a side of the ammunition carton packing apparatus to discharge and gather ammunition carton-packed pouches. The ammunition pouch mounter 30 may be positioned at a side of the shelter (not shown). For example, the ammunition pouch mounter 30 may be disposed substantially in parallel with the shelter.

The ammunition feeder 10 may include a conveyor 11 and a vertical conveyance table seater 12. The ammunition vertical conveyor 20 may include a vertical conveyance table 21 and vertical conveyance column 22. The ammunition pouch mounter 30 may include an ammunition pouch mounting table 31, an ammunition pouch upper end clamp 32, an ammunition pouch lower end clamp 33, and a clamp interval adjustor 34. The ammunition pond opener 40 may include an ammunition pouch opening scoop 41, an air outlet 42, an opening scoop actuator 43, and a scoop interval adjustor 44. The ammunition horizontal conveyor 50 may include a forward conveyance path 51 and a forward advancer 52. The ammunition inserter 50 may include an ammunition inserting blade 61 and an ammunition return preventer 62.

When each ammunition pouch 2 is placed on the ammunition pouch mounting table 31, the ammunition pouch upper end clamp 32 and ammunition pouch lower end clamp 33 hold the upper and lower ends, respectively, of the ammunition pouch 2, and the ammunition pouch opening scoop 41 moves forth, back, up, and down above the ammunition pouch 2 to open the mouth of the ammunition pouch 2.

The ammunition feeder 10 is disposed at a side (e.g., left side) of the ammunition carton packing apparatus for horizontally feeding ammunition-packed cartons 1. When ammunition cartons 1 are stacked on a left-side table of the ammunition feeder 10, the ammunition feeder 10 may automatically sense the ammunition cartons 1 by a sensor (not shown) and horizontally supply the ammunition carton 1 on the conveyor 11 one by one downstream of the ammunition carton packing apparatus. The ammunition cartons 1 supplied up to the vertical conveyance table seater 12 are arranged at predetermined intervals.

When the ammunition cartons 1 horizontally arranged are delivered to the vertical conveyance table 21, the ammunition vertical conveyor 20 lifts the ammunition cartons 1 (which is referred to as vertical conveyance), and the ammunition horizontal conveyor 50 delivers the filled ammunition cartons 1 through the forward conveyance path 51 to the ammunition inserter 60 (which is referred to as horizontal conveyance or forward conveyance). This process is shown in FIG. 10.

The ammunition pouch mounter 30, the ammunition inserter 60 disposed behind the ammunition pouch mounter 30, and the ammunition pouch opener 40 disposed on the ammunition pouch mounter 30 may together insert the ammunition cartons 1 into ammunition pouches 2 while they face each other.

As described above, the ammunition pouch opener 40 may include a plurality of ammunition pouch opening scoops 41, air outlets 42, opening scoop actuators 43, and scoop interval adjustors 44. For example, the number of the ammunition pouch opening scoops 41 may be the same as the number of ammunition pouches 2 to be processed. The opening scoop actuators 43 may actuate their respective corresponding ammunition pouch opening scoops 41 to move forth, back, up, or down. The scoop interval adjustors 44 may vary the left-right interval between the ammunition pouch opening scoops 41.

The opening scoop actuators 43 may move up, down, forth, or back their respective corresponding ammunition pouch opening scoops 41 regardless of the operation of varying, the left-right interval by the scoop interval adjustors 44. The scoop interval adjustors 44 may vary the left-right interval between the ammunition pouch opening scoops 41 regardless of the operation of moving up, down, forth, or back by the opening scoop actuators 43. The ammunition pouch mounter 30 or the ammunition pouch opener 40 may sometimes need (e.g., horizontal) variations in left-right interval between the ammunition cartons 1 or between the ammunition pouch opening scoops 41 during the course of opening or inserting the ammunition cartons 1 into the ammunition pouches 2 unlike the ammunition inserter 60, and the left-right interval variation may be freely performed without restriction by the mounting and opening operations.

Each ammunition pouch opening scoop 41 includes a rear edge that may penetrate underneath the cover of the ammunition pouch 2 and a front hook that may lift a rim portion of the mouth of the ammunition pouch 2. The rear edge of the ammunition pouch opening scoop 41 may have an air outlet for allowing air to be jetted or blown into the inside of the cover of the ammunition pouch 2.

For example, each ammunition pouch opening scoop 41 may include a first flat piece, a second flat piece, and a third flat piece together forming a distorted U-shape bracket. The first flat piece may be coupled to the opening scoop actuator 43. The second flat piece connects the first flat piece and the third flat piece together. The second flat piece may be longer or larger than the third flat piece. The first flat piece and the second flat piece may form an obtuse angle, and the second flat piece and the third flat piece may form an acute angle. The second flat piece may correspond to the above-described rear edge, and the third flat piece may correspond to the above-described front hook.

As a flow of air is jetted into the inside of the cover of the ammunition pouch 2 the cover of the ammunition pouch 2 is floated and opened, and the rear edge of the ammunition pouch opening scoop 41 may be moved back to the cover of the ammunition pouch 2 by the opening scoop actuator 43. The rear edge of the ammunition pouch opening scoop 41 may then be rendered to descend and move forth by the opening scoop actuator 43 so that the rim portion of the mouth of the ammunition pouch 2 is hung on the front hook. The ammunition pouch opening scoop 41 is then hoisted by the opening scoop actuator 43 to open the mouth of the ammunition pouch 2. The opening process attic cover and mouth of the ammunition pouch 2 is illustrated in FIG. 11. As described herein, the directions "back" and "forth" may follow the above-described references for the operation directions as shown in FIG. 9.

The ammunition pouch mounter 30 may include all ammunition pouch mounting table 31, a plurality of ammunition pouch upper end clamps 32, a plurality of ammunition pouch lower end clamps 33, and clamp interval adjustors 34.

The number of ammunition pouch upper end clamps 32 or the ammunition pouch lower end clamps 33 may be the same as the number of the ammunition pouches 2 to be processed. The ammunition pouch upper end clamps 32 and the ammunition pouch lower end clamps 33 may be arranged horizontally. The ammunition pouch mounting table 31 may be sized or dimensioned to fit the width of the flat, stretched-out ammunition pouches 2. The ammunition pouch upper end clamps 32 clamp and fasten the upper ends of the ammunition pouches 2, and the ammunition pouch lower end clamps clamp and fasten the lower ends of the ammunition pouches 2. The clamp interval adjustors 34 may vary the left-right interval between the ammunition pouch upper end clamps 32 or between the ammunition pouch lower end clamps 33. The clamp interval adjustors 34 may be operated in a similar manner to that of the scoop interval adjustors 44.

The scoop interval adjustors 44 and the clamp interval adjustors 34 may be simultaneously operated when the ammunition pouches 2 are opened so that the left-right interval between the ammunition pouches 2 is substantially the same as the left-right interval between the ammunition inserting blades 61 arranged in the ammunition inserter 60. The scoop interval adjustors 44 and the clamp interval adjustors 34 may interwork together, at least, until the ammunition cartons 1 are inserted in position into the empty ammunition pouches 2.

The ammunition inserter 60 may include a plurality of ammunition inserting blades 61 and a plurality of ammunition return preventers 62. The ammunition inserting blades 61 may move back and forth. Each ammunition inserting blade 61 may be shaped as a spade, at least partially, surrounding a left and right surface and bottom surface of the ammunition carton 1 to allow the ammunition carton 1 to be inserted into the ammunition pouch 2 without being stuck to the mouth rim of the ammunition pouch 2. The ammunition inserting blade 61 may be fully inserted and pulled back from the inside of the ammunition pouch 2, eliminating unnecessary stress that the ammunition pouch 2 may apply to the ammunition carton 1.

Each ammunition return preventer 62 may move up or down and may function as a stopper or blocking all. The ammunition return preventer 62 may include a claw or clamp-shaped member that may descend to prevent the ammunition carton 1 already inserted into the ammunition pouch 2 from dragged out along with the ammunition inserting blade 61.

Thus, each ammunition pouch 2 may be packed with an ammunition carton 1 in a tidy and organized manner, and such process enables high efficient packaging since it is carried out irrespective of the number of ammunition pouches 2.

While the present disclosure has been shown and described with reference to exemplary embodiments thereof, it will be apparent to those of ordinary skill in the art that various changes in form and detail may be made thereto without departing from the spirit and scope of the present disclosure as defined by the following claims.

What is claimed is:

1. An apparatus for packing an ammunition carton in a pouch that comprises a mouth that includes a rim and a cover for naturally covering the mouth, the apparatus comprising: an ammunition feeder for receiving ammunition cartons and horizontally arranging the ammunition cartons in a left or right direction; an ammunition vertical conveyor for vertically conveying the horizontally arranged ammunition cartons to an ammunition horizontal conveyor disposed thereon; the ammunition horizontal conveyor for advancing the vertically conveyed ammunition cartons to an ammunition inserter disposed in front thereof; an ammunition pouch mounter disposed in front of the ammunition inserter and for placing and fastening empty ammunition pouches in a flat and stretched position; an ammunition pouch opener for opening the mouths of the ammunition pouches placed and fastened by the ammunition pouch mounter; and the ammunition inserter for advancing and inserting the ammunition cartons into the ammunition pouches, wherein the ammunition inserter includes spade-shaped inserting blades surrounding left and right surfaces and bottom surfaces of the ammunition cartons to allow the ammunition cartons to be inserted without being stuck to the rims of the ammunition pouches and ammunition return preventers for preventing the ammunition cartons from moving back when the ammunition inserting blades return after advancing and inserting the ammunition cartons, wherein the ammunition pouch opener includes ammunition pouch opening scoops and an opening scoop actuator for moving the ammunition pouch opening scoops, wherein each of the ammunition pouch opening scoops is shaped as a distorted U-shaped bracket including a first flat part, a second flat part having an air outlet and extending from the first flat part, and a third flat part extending from the second flat part, wherein the first flat part and the second flat part form an obtuse angle. and the second flat part and the third flat part form an acute angle, wherein the opening scoop actuator slides the ammunition pouch opening scoops under the covers of the ammunition pouches while blowing air through the air outlets of the second flat parts to lift up the covers of the ammunition pouches and then slides back the ammunition pouch opening scoops placing the third flat parts under the rims of the ammunition pouches and lifts up the ammunition pouch opening scoops to open the mouths of the ammunition pouches.

2. The apparatus of claim 1, wherein the number of the ammunition pouch opening scoops is the same as the number of the ammunition pouches, wherein the ammunition pouch opening scoops are horizontally arranged, wherein the ammunition pouch opener includes a scoop interval adjustor that adjusts a left-right interval between two adjacent ones of the ammunition pouch opening scoops, and wherein the opening scoop actuator moves back and forth in an upper or lower direction and a front or rear direction regardless of the adjustment of the left-right interval.

3. The apparatus of claim 2, wherein the ammunition pouch mounter includes:

ammunition pouch upper end clamps horizontally arranged to clamp and fasten upper ends of the ammunition pouches and ammunition pouch lower end clamps horizontally arranged to clamp and fasten lower ends of the ammunition pouches, the number of the ammunition pouch upper end clamps or the ammunition pouch lower end clamps being the same as the number of the ammunition pouches; and a clamp interval adjustor for varying a left-right interval between two adjacent ones of the ammunition pouch upper end clamps or between two adjacent ones of the ammunition pouch lower end clamps.

4. The apparatus of claim 3, wherein the scoop interval adjustor and the clamp interval adjustor are simultaneously operated when the ammunition pouches are opened so that a left-right interval between two adjacent ones of the ammunition pouches is the same as a left-right interval two adjacent ones of between the ammunition inserting blades.

5. The apparatus of claim 1, wherein the second flat part and the third flat part are bent at an acute angle with respect to each other.

6. The apparatus of claim 5, wherein the third flat part is shorter than the second flat part.

7. The apparatus of claim 5, wherein a width of the second flat part or the third flat part is larger than a thickness of the second flat part or the third flat part.

* * * * *